US005702026A

United States Patent [19]

Lindquist

[11] Patent Number: 5,702,026

[45] Date of Patent: Dec. 30, 1997

[54] CONTAINER WITH SECONDARY CONTAINMENT VENTING BY FORM OF CONSTRUCTION

[75] Inventor: Thomas R. Lindquist, Denair, Calif.

[73] Assignee: Convault, Inc., Denair, Calif.

[21] Appl. No.: 634,307

[22] Filed: Apr. 16, 1996

[51] Int. Cl.[6] ..... B65D 90/02

[52] U.S. Cl. ..... 220/745; 220/645; 220/565

[58] Field of Search ..... 220/445, 446, 220/447, 448, 469, 902, 677, 645, 23.83, 23.86, 468, 457, 454, 452, 444, 426, 421, 415, 586, 565

[56] References Cited

U.S. PATENT DOCUMENTS

| | | | |
|---|---|---|---|
| 3,455,483 | 7/1969 | Inklaar | 220/645 |
| 4,963,082 | 10/1990 | Lindquist et al. | 415/117 |
| 5,157,888 | 10/1992 | Lindquist | 52/741 |
| 5,269,173 | 12/1993 | Henneck et al. | 220/565 |
| 5,271,493 | 12/1993 | Hall | 220/445 |
| 5,282,546 | 2/1994 | Bauer | 220/445 |
| 5,285,914 | 2/1994 | Del Zotto | 220/445 |
| 5,335,815 | 8/1994 | Josselyn | 220/445 |
| 5,395,007 | 3/1995 | Housholder et al. | 220/448 |
| 5,450,978 | 9/1995 | Crisp et al. | 220/469 |

*Primary Examiner*—Stephen J. Castellano

*Attorney, Agent, or Firm*—Townsend and Townsend and Crew LLP

[57] ABSTRACT

A storage container (2) having secondary containment venting by form of construction includes an primary container (4) defining a primary containment region (24), a secondary container (6) and an interstice (8) therebetween. A portion of the top (16) of the secondary container is weakened so that in the event of an overpressure within the interstice, the weakened region fails allowing the overpressure to be vented to atmosphere. Two bands (34, 36) of fluid-accepting and -conducting material are wrapped at an angle to one another around the primary container within the interstice. The bands of material help to ensure that any overpressure within the interstice is substantially equalized throughout the interstice so that if the secondary container does fail, it fails at the weakened region.

13 Claims, 3 Drawing Sheets

CONTAINER WITH SECONDARY CONTAINMENT VENTING BY FORM OF CONSTRUCTION

BACKGROUND OF THE INVENTION

Many fluids, such as liquid fuels, are stored in double-wall tanks or other containers to provide primary and secondary containment for the stored fluid. These double-wall tanks include inner (or primary) and outer (or secondary) containers defining an interstice between the two. See U.S. Pat. Nos. 4,963,082 and 5,157,888, the disclosures of which are incorporated by reference. Emergency venting is typically required by fire codes for the primary containment region within the inner container. In addition, emergency relief venting of the interstice is also often required. A main purpose of the secondary containment emergency venting is to prevent catastrophic failure of either of the primary or secondary containment by relieving overpressure within the interstice.

Secondary containment emergency venting for many above-ground tanks is provided by a venting device which couples the interstice to atmosphere when the interstice pressure reaches a pre-set level. Emergency venting can also be provided by construction features, such as a purposely weak shell-to-roof seam which will rupture locally, in a controlled manner, when the space is subjected to an overpressure. This type of emergency venting is often called venting by form of construction.

SUMMARY OF THE INVENTION

The present invention is directed to an improvement in a container with secondary containment venting by form of construction. The container includes a primary (inner) container defining a primary containment region and a secondary (outer) container. The primary and secondary containers define an interstice therebetween. A portion of the secondary container, preferably at the perimeter of the top of the secondary container, is weak so that in the event of an overpressure within the interstice, the weak region fails allowing the overpressure to be vented to atmosphere. The improvement is directed to the use of fluid-accepting and -conducting material, typically in the form of webs or bands of high-density polyethylene wrapped around the primary container within the interstice. Typically two continuous bands of the fluid-accepting and -conducting material are wound about the primary container in directions oriented transverse, such as 90°, to one another. This helps to ensure that the pressure within the interstice is substantially equalized throughout the interstice so that if the secondary container does fail due to an overpressure within the interstice, it fails at the weakened region.

A primary advantage of the invention is that it provides enhanced venting by form of construction in a simple and economical manner. It also eliminates the need for use of a secondary containment venting connections and devices. In addition, the fluid-accepting and -conducting material helps to ensure that the interstice is properly filled during hydrostatic pressure testing.

Other features and advantages of the invention will appear from the following description in which the preferred embodiment has been set forth in detail in conjunction with the accompanying drawings.

DESCRIPTION OF THE PREFERRED EMBODIMENT

Figure 1:
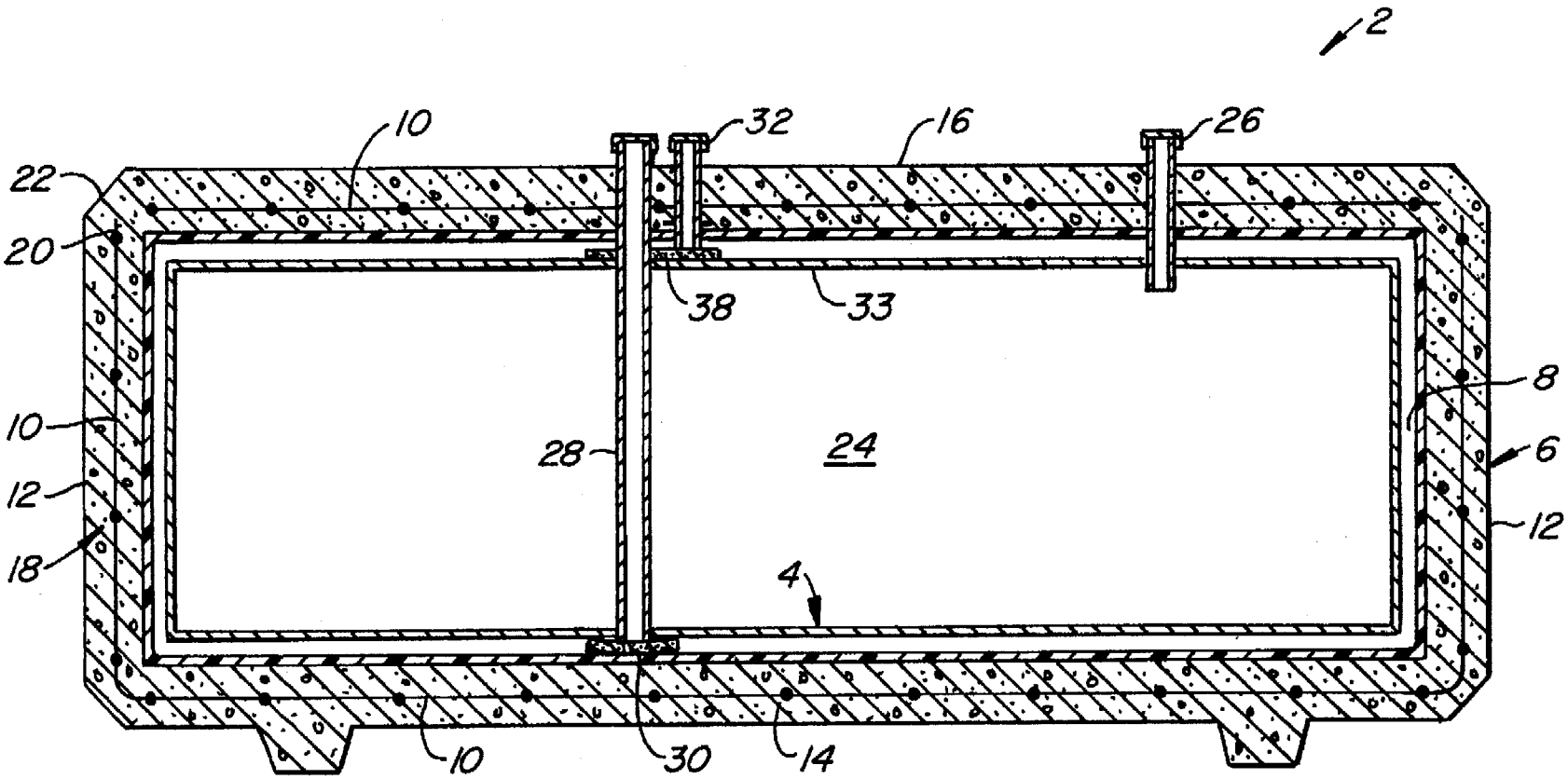
FIG. 1 is a side cross-sectional view, taken along line 1—1 of FIG. 3, of an above-ground storage container made according to the invention.
Figure 2:
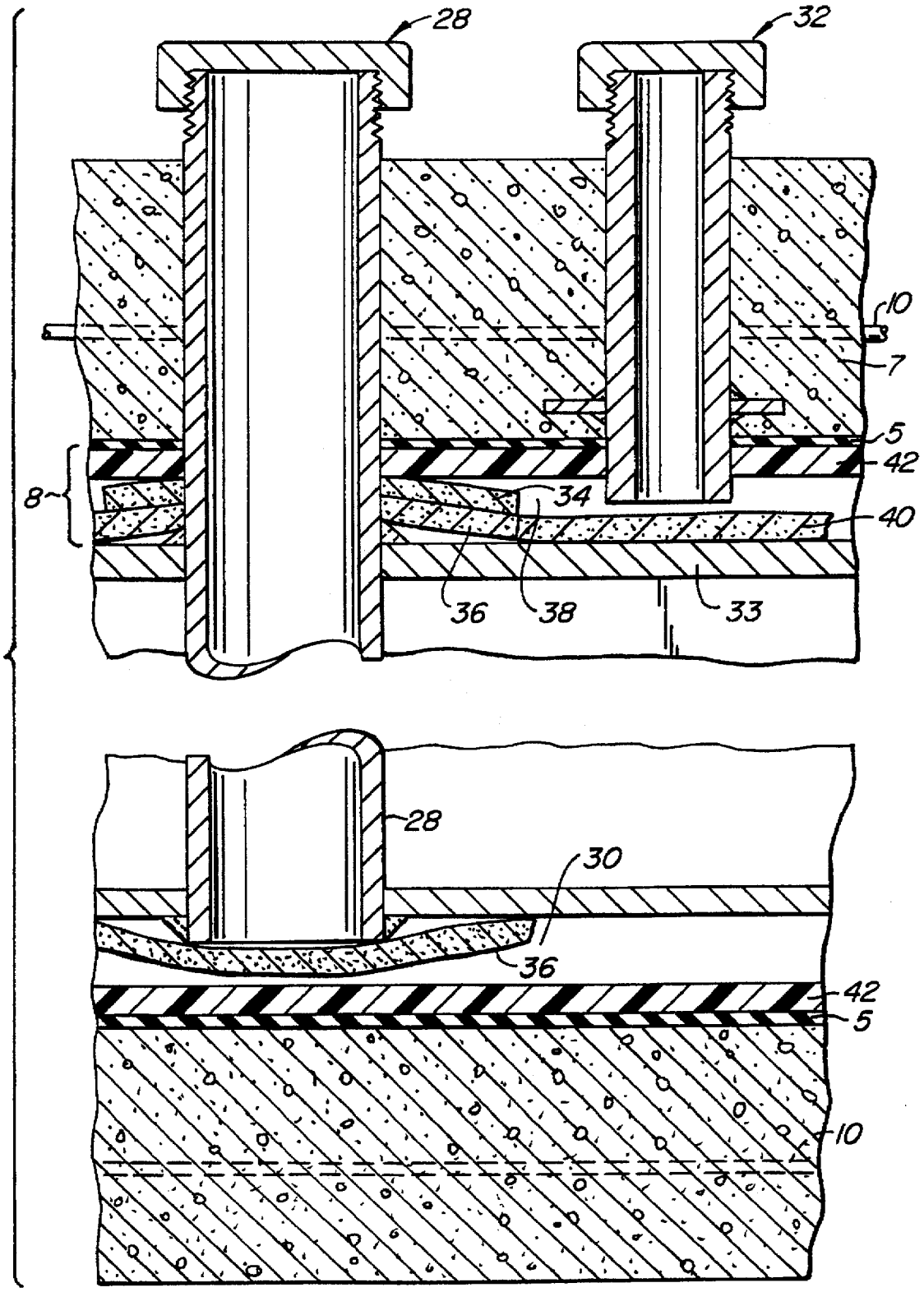
FIG. 2 is an enlarged view of a portion of the container of FIG. 1 showing the through-tank leak detector tube and secondary containment communication fitting.

FIG. 1 illustrates an above-ground storage container 2 made according to the invention. Container 2 is specially adapted for the above-ground storage of flammable liquids and is rectangular in shape. Moreover, container 2 could be other shapes and could be configured for storage of other materials as well. Storage container 2 includes broadly a primary container 4, typically made of carbon steel, a secondary container 6, typically made of a high density polyethylene liner 5 surrounded by reinforced concrete 7, the primary and secondary containers defining an interstice 8 therebetween. Reinforced concrete secondary container 6 includes rebar 10 along the side walls 12, bottom 14 and top 16 of the secondary container. Rebar 10 along side walls 12 and bottom 14 are tied together where they meet at the edges of container 2 to provide a box-like lower cage 18. Rebar 10 along top 16 is not fixed to the upper edge 20 of rebar cage 18 but is positioned at or near upper edge 20, such as in the manner of a top of a shoe box. Thus, the joint along the upper beveled edge 22 of secondary container 6 is weaker than the remainder of secondary container 6. This provides the possibility of venting by form of construction as will be discussed below.

Storage container 2 typically contains a number of pipes, tubes and fittings for various purposes, including filling the primary containment region 24 defined by primary container 4 through a fill tube 26, and a through-tank leak detector tube 28 used to monitor the bottom region 30 of interstice 8. In addition, an interstice communication fitting 32 passes through top portion 16 of upper container 6 and opens into interstice 8 above the top 33 of primary container 4. Fitting 32 can be used to provide access to interstice 8 during various tests. Other access ways, such as manways, tubes for venting primary containment region 24, overflow protectors, etc., can also be used with storage container 2. Storage container 2 thus far described is conventional.

Figure 3:
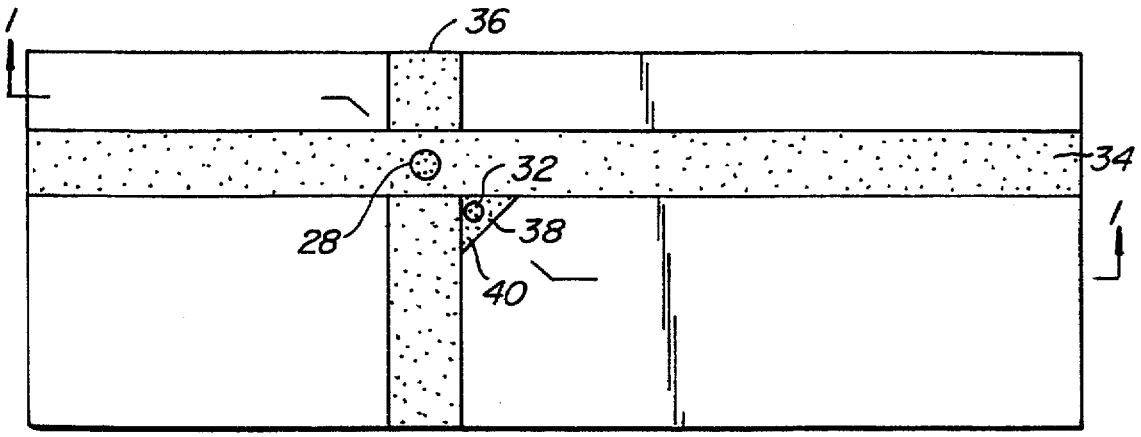
FIG. 3 and 4 are simplified top and bottom views showing how the bands of fluid-accepting and -conducting material are wrapped around the primary container.
Figure 4:
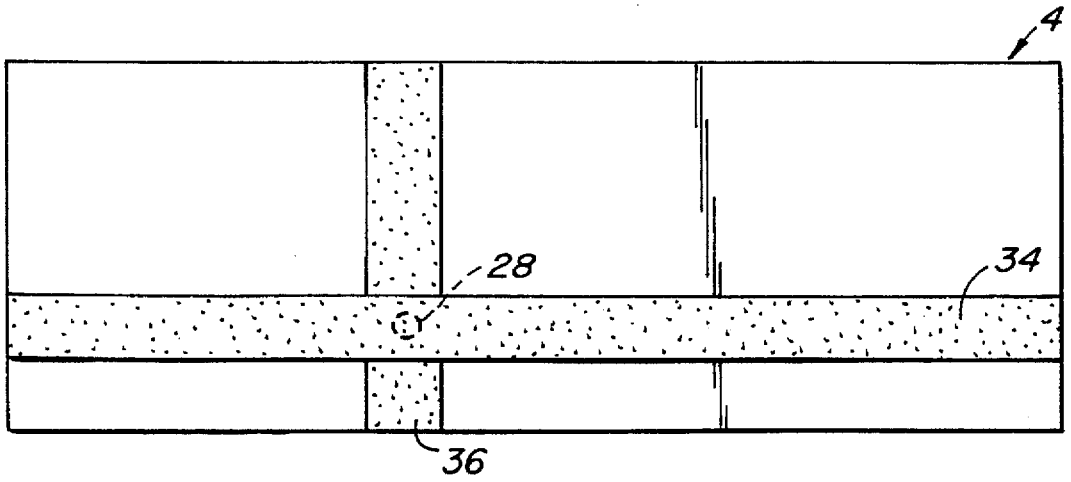

The fluid communication within interstice 8 adjacent to side walls 12, bottom 14 and top 16 is enhanced by the use of webs or bands 34, 36 wrapped around primary container 4 as illustrated in FIGS. 3 and 4. Bands 34, 36 should also be compatible with the product to be contained within region 24. Bands 34, 36 are made of a material which is fluid-accepting and -conducting so to provide fluid paths along the various regions of interstice 8. This is especially important at the edges of storage container 2. Bands 34, 36 meet at an upper portion 38 of interstice 8 in the vicinity of tube 28 and fitting 32. An additional section 40 of the same material as bands 34, 36 can be used to augment bands 34, 36 to enlarge upper portion 38 of interstice 8. Bands 34, 36 and section 40 made of webbing material. One such material is sold by Gundle Co. of Texas as GEONET. GEONET is high-density polyethylene material 6" wide and about ¼" thick. Bands 34, 36 of fluid-accepting and -conducting material could be made of other open matrix material or a band of small-diameter tubes having numerous holes formed in the walls of the tubes.

A thermal insulation layer 42 is used on top of bands 34, 36. Layer 42 is preferably extruded polystyrene, typically having a ¼" minimum thickness. Between layer 42 and the reinforced concrete 7 is liner 5. Liner 5 is preferably made of two sheets. The first sheet is used adjacent to the bottom and side walls of primary container 4 and is wrapped over and secured to the top of the primary container, typically using tape. The first sheet of liner 5 is typically 30 mils thick. The second sheet, typically 6 mils thick, is used to cover the top of primary container 4 and is also secured in place using tape. Accordingly, reinforced concrete 7 and liner 5 together constitute container 6 and create interstice 8 between the secondary container 6 and the primary container 4. The use of layer 42 and liner 5 is conventional.

In use, when an overpressure occurs in interstice 8, such as if storage container 2 is subjected to fire, bands 34, 36 of fluid-accepting and -conducting material help to ensure that the overpressure is equally distributed throughout interstice 8. In particular, it is desired that upper portion 38 of interstice 8 be at a pressure which is equal to, or at least not substantially lower than, the pressure at any other part of interstice 8 to ensure that the pressures exerted within interstice 8 on secondary container 6 are as high at top 16 as at bottom 14 or side walls 12. This helps to ensure that any sufficiently large overpressure within interstice 8 is vented to the atmosphere by failure of secondary container 6 at upper beveled edge 22 of the secondary container. This creates the desired emergency venting of the secondary containment by form of construction. Specifically, by not securing rebar 10 at top 16 to upper edge 20 of lower rebar cage 18, upper beveled edge 22 is weaker than the rest of secondary container 6. If venting of overpressure by form of construction within interstice 8 occurs, such venting occurs primarily by a fracture in concrete 7 at upper beveled edge 22 as is desired.

Modification and variation can be made to the disclosed embodiment without departing from the subject of the invention as defined in the following claims. For example, primary container 4 could be itself a dual-wall container so that the interstice which is vented by form of construction would actually be the interstice for a tertiary containment. Storage container 2 could be other than a steel tank embedded with a layer of reinforced concrete. A weak region of top 16 could be at one or more positions in addition to or other than upper beveled edges 22 if so desired. Storage container could be a horizontally-disposed cylindrical container with weak regions along its upper portion, such as at both ends and/or along its entire upper portion.

What is claimed is:

1. In an above-ground storage container of the type having inner and secondary containers, the secondary container comprising top, bottom and side walls, the top of the secondary container having a weakened region to provide venting by construction in the event of an overpressure within a interstice defined between the inner and secondary containers, the improvement comprising:

bands of fluid-accepting and -conducting material fluidly coupling portions of the interstice, adjacent to the bottom and each of the side walls, to an upper portion of the interstice adjacent to the top wall to help equalize pressure throughout the interstice; and said bands of fluid-accepting and -conducting material comprising at least two continuous bands circumscribing said primary container, oriented transverse to one another and crossing at said upper portion of the interstice.

2. The container according to claim 1 wherein said bands are oriented about 90° to one another.

3. In an above-ground storage container of the type having inner and secondary containers, the secondary container comprising top, bottom and side walls, the top of the secondary container having a weakened region to provide venting by construction in the event of an overpressure within the interstice defined between the inner and secondary container, the improvement comprising:

fluid-accepting and -conducting material fluidly coupling portions of the interstice, adjacent to at least some of the bottom and side walls, to an upper portion of the interstice adjacent to the top wall to help equalize pressure throughout the interstice, said fluid-accepting and -conducting material comprising at least two continuous bands circumscribing said primary container and crossing at said upper portion of the interstice.

4. An above-ground storage container comprising:

a secondary container having at least one surrounding wall which is integrally molded in one-piece and completely surrounds and continuously encloses the primary container, said surrounding wall having a top portion overlying the top;

the secondary and primary containers defining an interstice therebetween;

fluid-accepting and -conducting material within the interstice fluidly coupling portions of the interstice along fluid paths, adjacent to at least some of the side walls and bottom, to an upper portion of the interstice between the top and the top portion; and at least a part of the top portion being weaker than the remainder of said surrounding wall when subjected to a positive pressure within the interstice so that said part fails prior to said remainder when said interstice is subjected to an increasing positive pressure, thus providing a fluid escape passageway from the interstice to the ambient environment.

5. The container according to claim 4 wherein said fluid-accepting and -conducting material fluidly couples portions of the interstice adjacent to each of said side walls and said bottom to said upper portion.

6. The container according to claim 4 wherein said fluid-accepting and -conducting material comprises a layer of high-density polyethylene material about 6 mm (¼") thick.

7. The container according to claim 4 wherein said fluid-accepting and -conducting material comprises at least two continuous bands circumscribing said primary container and crossing at said upper portion of the interstice.

8. The container according to claim 4 wherein said weaker part of the top portion comprises a junction region coupling the top portion to side portions of the surrounding wall.

9. The container according to claim 4 wherein said primary container comprises a single-wall container.

10. The container according to claim 4 wherein said surrounding wall comprises reinforced concrete and a high-density polyethylene liner.

11. The container according to claim 10 wherein said reinforced concrete comprises rebar along side portions, a bottom portion and the top portion, the rebar along the side portions and the bottom portion being secured together, the rebar along the top portion being substantially unsecured to the rebar along the side portions.

12. An above-ground storage container comprising:

a primary container having a top, a bottom and side walls coupling the top and the bottom, the primary container defining a primary containment region therein;

a secondary container enclosing the primary container and having a top portion overlying the top, the secondary and primary containers defining an interstice therebetween;

at least a part of said top portion being weaker than the remainder of the secondary container when subjected to a positive pressure within the interstice so that said part fails prior to said remainder when said interstice is subjected to an increasing positive pressure, thus providing a fluid escape passageway from the interstice to the ambient environment; and fluid-accepting and -conducting material within the interstice fluidly coupling portions of the interstice, adjacent to at least some of the side walls and bottom, to an upper portion of the interstice between the top and the top portion, said fluid-accepting and -conducting material comprising at least two continuous bands circumscribing said primary container and crossing at said upper portion of the interstice.

13. An above-ground storage container comprising:

a primary container having a top, a bottom and side walls coupling the top and the bottom, the primary container defining a primary containment region therein;

a secondary container enclosing the primary container and having a top portion overlying the top, the secondary and primary containers defining an interstice therebetween;

said secondary container comprising reinforced concrete and a high-density polyethylene liner;

fluid-accepting and -conducting material within the interstice fluidly coupling portions of the interstice, adjacent to at least some of the side walls and bottom, to an upper portion of the interstice between the top and the top portion; and said reinforced concrete comprising rebar along side portions, a bottom portion and the top portion, the rebar along the side portions and the bottom portions being secured together, the rebar along the top portion being substantially unsecured to the rebar along the side portions at a junction region so said junction region is weaker than the remainder of the secondary container when subjected to a positive pressure within the interstice so that said junction region fails prior to said remainder when said interstice is subjected to an increasing positive pressure, thus providing a fluid escape passageway from the interstice to the ambient environment.

* * * * *